US005241911A

United States Patent [19]

Lück et al.

[11] Patent Number: 5,241,911

[45] Date of Patent: Sep. 7, 1993

[54] CONVEYOR SYSTEM INCLUDING A SUPPORT RAIL WITH TRAVEL SURFACES FOR DRIVEN SUPPORT WHEELS OF VEHICLES

[75] Inventors: Jochen Lück, Wetter; Johannes Gerhard Spöler, Borken, both of Fed. Rep. of Germany

[73] Assignee: Mannesmann Aktiengesellschaft, Dusseldorf, Fed. Rep. of Germany

[21] Appl. No.: 904,817

[22] Filed: Jun. 26, 1992

[30] Foreign Application Priority Data

Jun. 27, 1991 [DE] Fed. Rep. of Germany ..... 4121516

[51] Int. Cl.[5] ..... B61B 3/02

[52] U.S. Cl. ..... 104/89; 104/93; 104/165; 104/111; 104/306; 105/73; 105/75

[58] Field of Search ..... 104/89, 93, 164, 94, 104/95, 127, 128, 129, 165, 243, 306, 111; 105/30, 73, 75, 148, 150, 152, 156, 153

[56] References Cited

U.S. PATENT DOCUMENTS

| | | | |
|---|---|---|---|
| 2,751,851 | 6/1956 | Curtis et al. | 104/93 |
| 4,798,146 | 1/1989 | Roetzel | 104/93 |
| 5,092,249 | 3/1992 | Knuettel | 105/150 |

FOREIGN PATENT DOCUMENTS

| | | | |
|---|---|---|---|
| 0292401 | 12/1990 | Japan | 104/93 |
| 0054066 | 3/1991 | Japan . | |

*Primary Examiner*—Mark T. Le

*Attorney, Agent, or Firm*—Cohen, Pontani, Lieberman, Pavane

[57] ABSTRACT

A conveyor system includes a support rail with travel surfaces for driven support wheels of vehicles, such as suspended or elevated trolleys or the like. An additional rail is provided for additional wheels which apply contact pressure to the support wheels. Such a conveyor system with a plurality of vehicles and a small number of ascending and descending paths is simplified by supporting the additional rail directly or indirectly through springs on the support rail.

15 Claims, 3 Drawing Sheets

CONVEYOR SYSTEM INCLUDING A SUPPORT RAIL WITH TRAVEL SURFACES FOR DRIVEN SUPPORT WHEELS OF VEHICLES

BACKGROUND OF THE INVENTION

1. Field of the Invention

The present invention relates to a conveyor system including a support rail with travel surfaces for driven support wheels of vehicles, such as suspended or elevated trolleys or the like, with an additional rail associated with support rail for additional wheels acting on the support wheels.

2. Description of the Related Art

In conveyor systems of the above-decribed type, as disclosed in German Patent 47 42 43 and German Patent 39 05 210, springs always act on the additional wheels. Along ascending and descending paths, the additional wheels come into contact with additional rails so that the support wheels are additionally loaded in order to increase the frictional engagement thereof. By the spring mounting of the additional rails, the cost of the trolleys is increased. This is not particularly disadvantageous if only a few trolleys are used in a conveyor system. However, when a large number of trolleys are employed in a conveyor system, the additional expense for the spring mounting of the additional wheels constitutes a disadvantage, particularly when they are used only infrequently within the conveyor system, for instance when only one ascending path and one descending path are present.

SUMMARY OF THE INVENTION

Therefore, it is an object of the present invention to simplify a conveyor system of the above-described type having a large number of vehicles and few ascending and descending paths.

This object is met, in accordance with the present invention, by supporting the additional rail via springs directly or indirectly on the support rail.

The spring-mounted support rail causes the system to be more complicated in the region of the ascending and descending paths, however, the large number of vehicles are less complicated because of the elimination of the spring mounting of the additional wheels so that, as a whole, a simplified construction results.

The additional rail is preferably arranged above the travel surface of the support rail by brackets on a support structure and is formed of individual sections which are shorter than the distance between two trolleys which are connected together via a support crossmember to form a travel unit.

The two trolleys, only one of which need have a travel motor, have rigid support bars which extend perpendicularly to the support rail and have pin-type extensions for holes in the support crossmember. Upon travel onto and from vertical curves at transitions to ascending and descending paths or to a straight path, the vertical position of the travel unit changes relative to the travel surface. This difference is compensated by the spring support of the additional rail, the distance of which from the travel surface being capable of yielding by about 10–20 mm. Furthermore, manufacturing tolerances and wear of the support wheels are compensated.

The last section at either end of the additional rail is preferably constructed with entrance or exit slopes and has, at each end, a greater distance from the travel surface than in the rest of the region.

In accordance with a further developement of the invention, each trolley is guided via guide rollers on side surfaces of the support rail, so that the trolleys can also travel over support rails with horizontal curves.

The sections of the support rail are preferably connected to each other by means of pivot pins which are passed through holes and they are guided by a guide web on a support structure. The guide web has a slot for a bolt which is guided through a hole in a pressure plate for the spring which consists of an elastic ring. The pressure plate is supported by means of a bracket on a support structure which also supports the support rail.

The additional wheel is driven through frictional engagement with the support wheel and is mounted for swinging on a drag rocker. The additional wheel is pressed against the support wheel only in the region of the additional rail and increases the pressure of the support wheel on the travel surface of the support rail and, thus, the frictional engagement, while it is otherwise without pressure, does not require any drive force.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there is illustrated and described a preferred embodiment of the invention.

DESCRIPTION OF THE PRESENTLY PREFERRED EMBODIMENT

Figure 1:
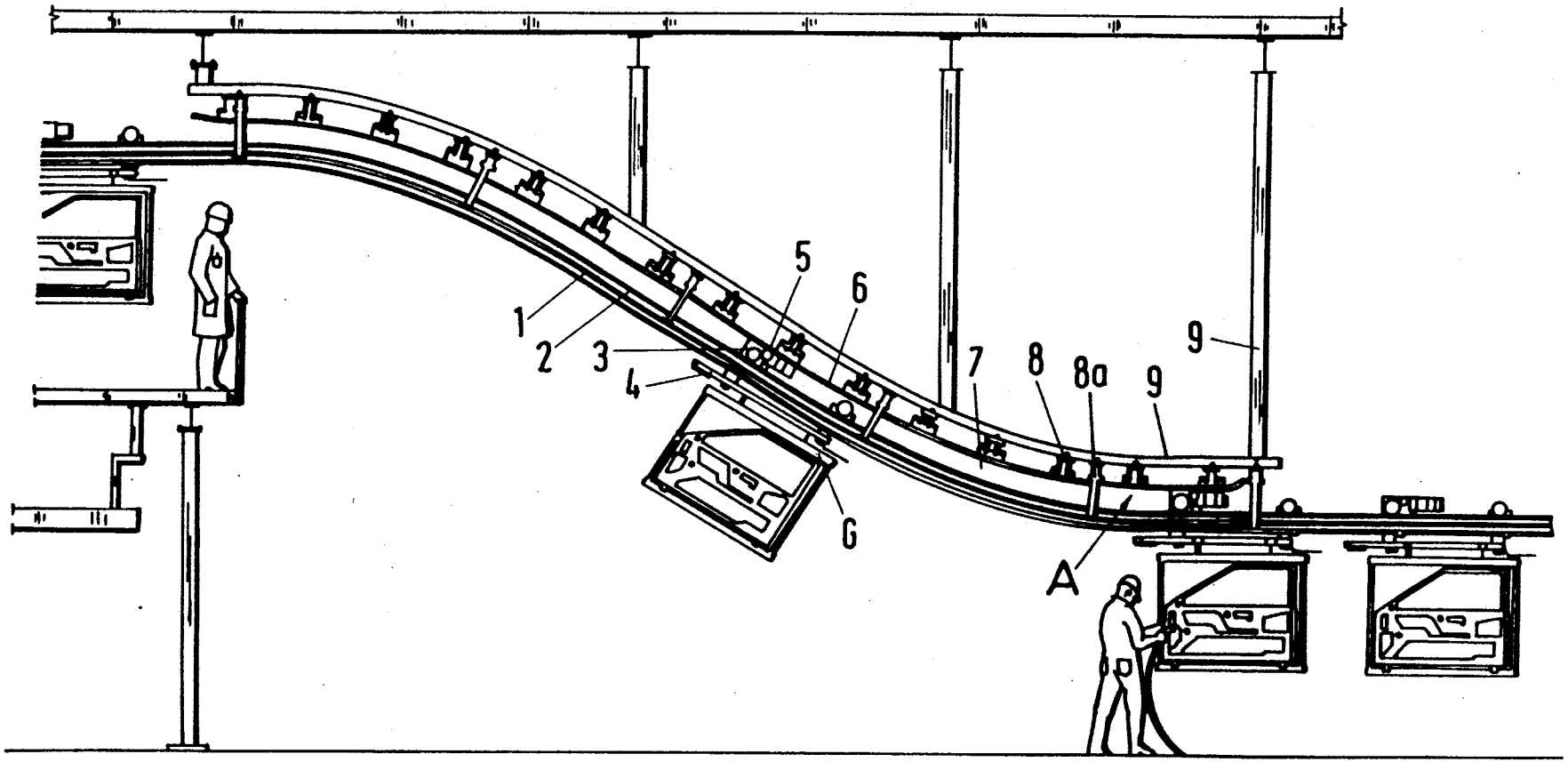
FIG. 1 is a side view of a portion of a conveyor system with an ascending path.
Figure 3:
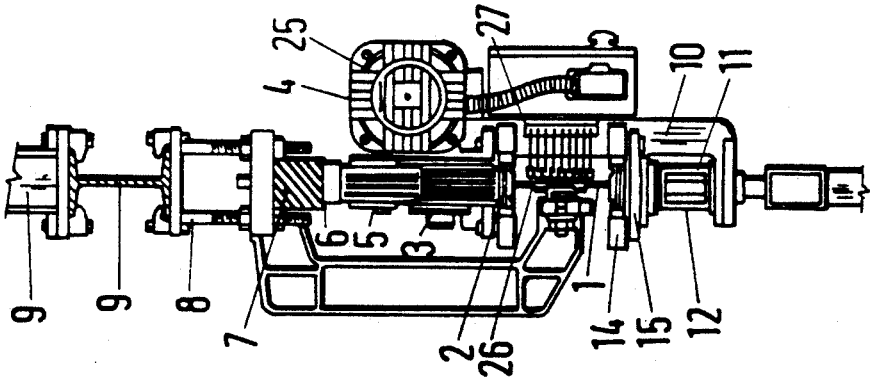
FIG. 3 is a sectional view along sectional line III—III of FIG. 2.

An upper flange of a support rail 1 forms a travel surface 2 for support wheels 3 of trolleys 4. Two trolleys 4 form a travel unit, one of the trolleys 4 of each travel unit has an additional wheel 5 arranged spaced in direction of travel from the support wheel 3 and driven by frictional engagement. The additional wheel 5 enters, within the region of ascending and descending paths or within the region of accelerating or decelerating paths of a conveyor system, into a region with an additional rail 6 and increases the contact pressure of the support wheel 3 against the travel surface so that even large inclines can be overcome. The incline may possibly be further increased by the use of a ribbed additional rail. The additional rail 6 is formed of sections and is supported by means of springs 7 and brackets 8 or screws on a support structure 9, which also has brackets 8*a* for the support rail 1 on which rods G with passenger-car doors are transported.

Figure 2:
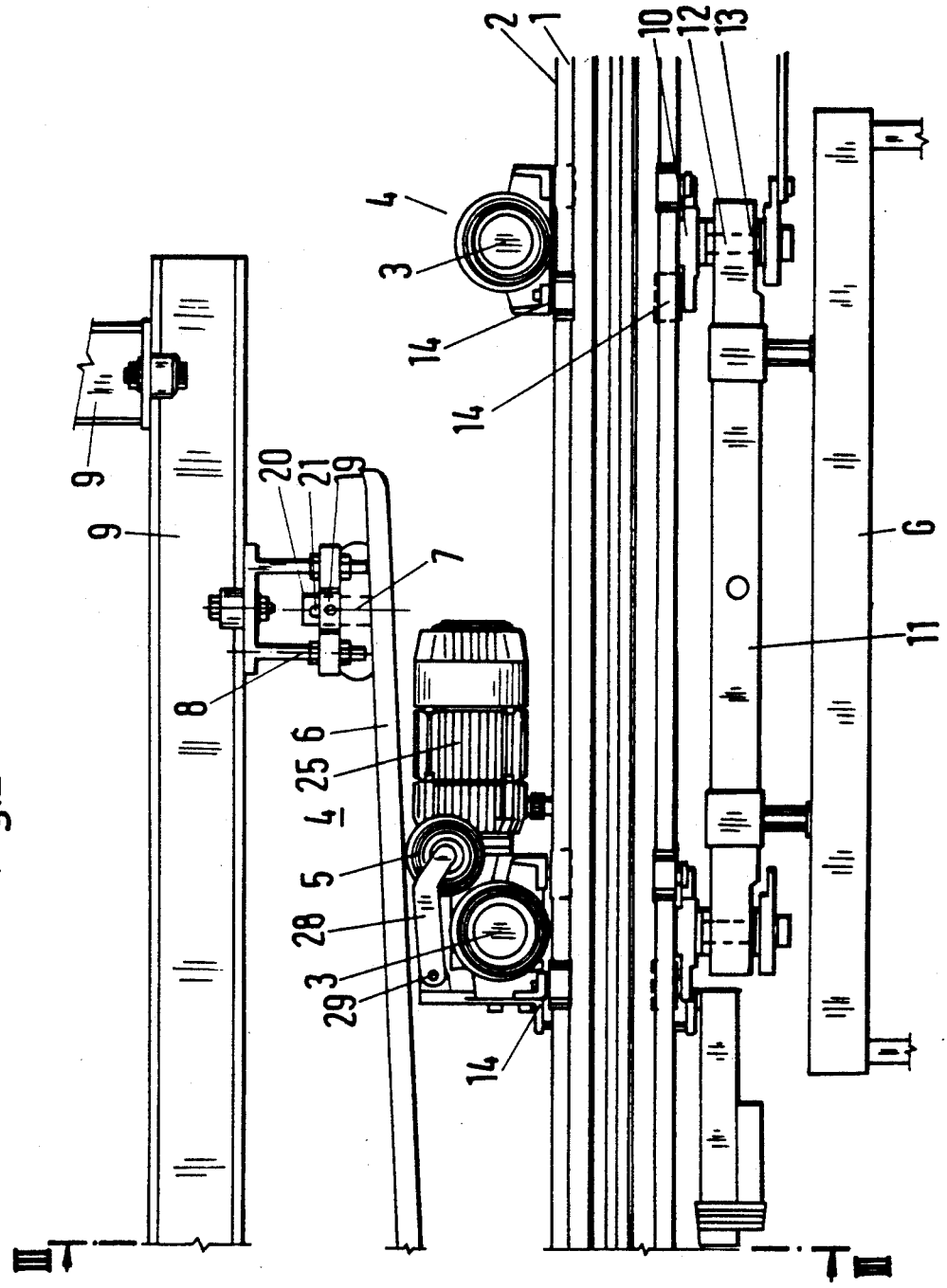
FIG. 2 shows the entrance region of FIG. 1 on a larger scale.

As shown in FIG. 2, each trolley has a rigid, downwardly directed support rod 10 for a support cross member 11 which connects the trolleys together and supports the goods to be transported. The pin extensions 12 of the support rods 10 extend through holes 13 or sleeves in the support crossmember 11, so that the trolleys 4 secure each other against tilting in longitudinal direction. The pin extensions 12 and holes 13 permit travel around curves, each trolley 4 being guided on the support rail 1 by four guide rollers 14 which are mounted crosswise on plates 15 of the support rods 10. Of the two trolleys 4 of the travel unit which are shown in FIGS. 1 and 2, only one is provided with a travel motor 25 and the additional wheel 5 which is pivoted to the trolley 4 via a non-driven rocker 28 and a mounting bolt 29. The travel motor 25 of the trolley 24 is supplied with energy and control pulses through contact lines 26 and current pickups 27.

Due to the distance between the trolleys 4 of a travel unit, the vertical distance between the contact surfaces of support wheels 3 and the additional wheels 5 arranged behind or in front of them changes continuously when traveling through vertical curves, particularly at the entrance and the exit of each curve. These variations in distance are compensated by the springs 7 on which the sections of the additional rail 6 rest. The sections are shorter than the wheel base of the trolleys 4 of a travel unit, as can be seen in FIG. 1. In this way, tolerances can be compensated from vehicle to vehicle, so that a vehicle with excess dimensions does not remove the clamping force for the following vehicle.

Figure 4:
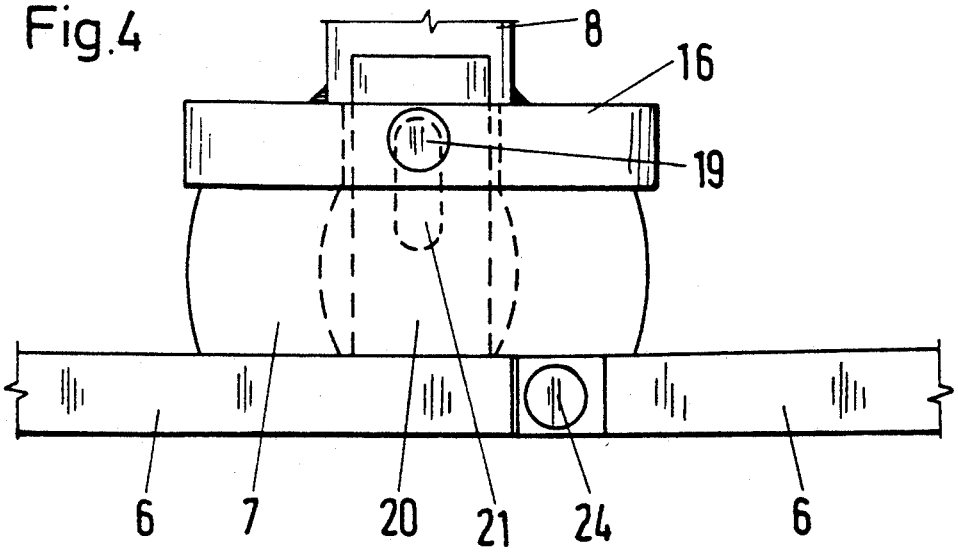
FIG. 4 shows detail A of FIG. 1 on a larger scale.
Figure 5:
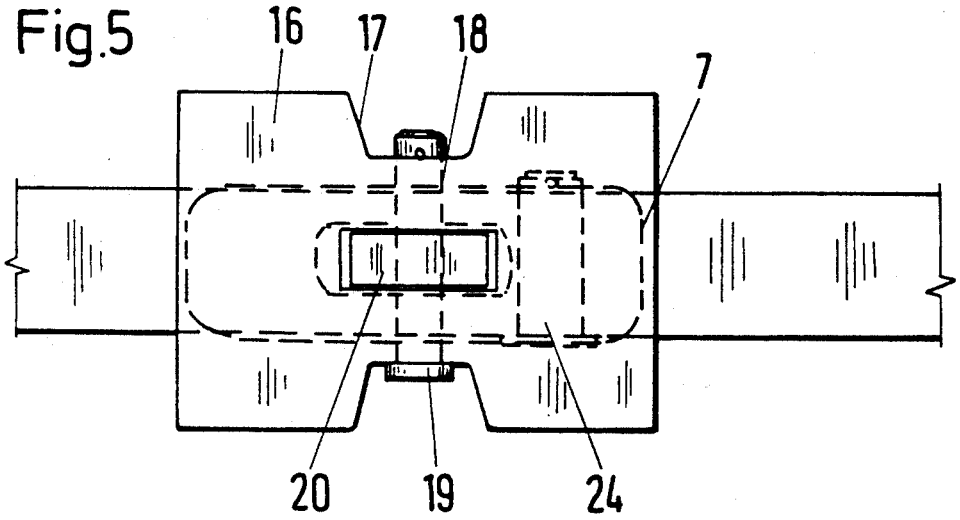
FIG. 5 is a top view of the detail of FIG. 4.
Figure 6:
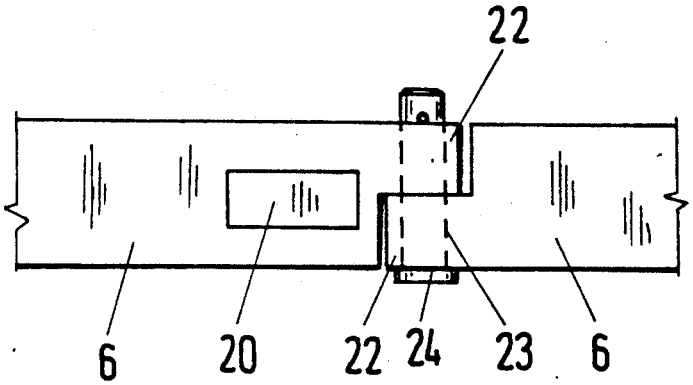
FIG. 6 is a top view of the connection of two additional rails.

FIGS. 4 to 6 show the attachment of the sections of the additional rail 6 to each other and their support via the springs 7 on pressure plates 16 of the brackets 8. Each pressure plate 8, as shown in FIG. 5, has lateral cutouts 17 and a bore hole 18 for a bolt 19. On the latter, there is guided a section of the additional rail 6 at one end via a guide web 20 having a slot 21. The additional rails 6 are provided at the ends, as shown in FIG. 6, with flattenings 22 and holes 24 for pivot pins 24, so that no offset occurs between the individual sections.

Each guide web 20 extends through the spring 7. The spring 7 is constructed as a ring and is made of Vulkolan.

It should be understood that the preferred embodiments and examples described are for illustrative purposes only and are not to be construed as limiting the scope of the present invention which is properly delineated only in the appended claims.

We claim:

1. A conveyor system comprising a support rail with a travel surface, a plurality of trolleys, each trolley having a support wheel traveling on the travel surface of the support rail, at least some of the trolleys having means for driving the support wheel and an additional wheel for applying a load on the support wheel, an additional rail for contacting the additional wheel, further comprising a support structure and brackets connected to the support structure, springs for connecting the additional rail to the brackets, the support having additional brackets connected to the support structure.

2. The conveyor system according to claim 1, wherein the additional rail is arranged above the travel surface of the support rail.

3. The conveyor system according to claim 1, wherein the additional wheel is mounted with frictional engagement with the support wheel, such that the additional wheel is driven by the support wheel.

4. The conveyor system according to claim 1, wherein the additional rail comprises a plurality of individual sections.

5. The conveyor system according to claim 4, wherein two trolleys are connected to each other to form a travel unit, a support crossmember connecting the two trolleys of a travel unit, wherein the individual sections of the additional rail are shorter than the distance between two trolleys of a travel unit.

6. The conveyor system according to claim 5, wherein only one of the trolleys of each travel unit is equipped with a drive motor.

7. The conveyor system according to claim 5, wherein each trolley has a rigid support rod extending perpendicularly with respect to the support rail, each support rod having a pin extension, the support crossmember having bore holes, the pin extensions being received in the bore holes.

8. The conveyor system according to claim 4, wherein the sections of the additional rail comprise outer sections and main portion sections between the outer sections, the outer sections having free ends, wherein the free ends have a distance from the travel surface of the support rail which is greater than the distance of the main portion sections from the travel surface of the support rail.

9. The conveyor system according to claim 5, wherein each trolley has guide rollers, and the support rail has side surfaces for guiding the guide rollers.

10. The conveyor system according to claim 5, wherein the individual sections of the additional rail have ends with bore holes, pivot pins extending through the bore holes of adjacent sections for connecting the sections, further comprising a support structure with a guide web for guiding the sections.

11. The conveyor system according to claim 10, comprising brackets for connecting the additional rail to the support structure, the guide web having an oblong hole, a pressure plate for each spring being mounted on each bracket, the pressure plate having a bore hole, a bolt extending through the oblong hole of the guide web and through the bore hole of the pressure plate.

12. The conveyor system according to claim 10, wherein each spring is a ring, the guide web extending through the ring.

13. The conveyor system according to claim 1, wherein the springs are of a soft material.

14. The conveyor system according to claim 13, wherein the soft material is polyurethane Vulkolan.

15. The conveyor system according to claim 3, wherein each trolley includes a drag rocker member, and the additional wheel is connected to the drag rocker member so as to swing between the additional rail and the support wheel.

* * * * *